US006850182B2

(12) United States Patent
Hosoe et al.

(10) Patent No.: US 6,850,182 B2
(45) Date of Patent: Feb. 1, 2005

(54) ELECTROMAGNETIC WAVE ABSORBER

(75) Inventors: Akihisa Hosoe, Osaka (JP); Koji Nitta, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/640,376

(22) Filed: Aug. 14, 2003

(65) Prior Publication Data

US 2004/0032360 A1 Feb. 19, 2004

(30) Foreign Application Priority Data

Aug. 19, 2002 (JP) ..... 2002-237860

(51) Int. Cl.[7] ..... H01Q 17/00
(52) U.S. Cl. ..... 342/1; 342/4
(58) Field of Search ..... 342/1–4

(56) References Cited

U.S. PATENT DOCUMENTS 6,214,454 B1 * 4/2001 Kanda et al. ..... 428/294.7
2001/0009118 A1 * 7/2001 Hosoe et al. ..... 75/255
2001/0020054 A1 * 9/2001 Toyoda et al. ..... 523/137
2001/0048983 A1 * 12/2001 Yoshida et al. ..... 428/34.1
2002/0100574 A1 * 8/2002 Zabetakis ..... 164/132
2002/0198286 A1 * 12/2002 Igarashi et al. ..... 523/137
2003/0010408 A1 * 1/2003 Hoscoe et al. ..... 148/310
2003/0120197 A1 * 6/2003 Kaneko et al. ..... 604/21

FOREIGN PATENT DOCUMENTS

| | | |
|---|---|---|
| JP | 11-87117 | 3/1999 |
| JP | 11-354973 | 12/1999 |
| JP | 2000-4097 | 1/2000 |
| JP | 2002-158488 | 5/2002 |

OTHER PUBLICATIONS

"Recent Technology and Application of New Electromagnetic Wave Absorber," Mar. 10, 1993, CMC, pp. 124–125 (with English abstract).

* cited by examiner

*Primary Examiner*—Thomas H. Tarcza
*Assistant Examiner*—Isam Alsomiri
(74) *Attorney, Agent, or Firm*—McDermott Will & Emery LLP

(57) ABSTRACT

An electromagnetic wave absorber comprising a soft magnetic material powder and a binding material, wherein the composition of the flat powder of the soft magnetic material is Ni-30–60% Fe, is provided, and the electromagnetic wave absorber is thinner than conventional ones, has a high absorption performance for electromagnetic waves of 1 to 3 GHz.

6 Claims, 5 Drawing Sheets

ELECTROMAGNETIC WAVE ABSORBER

BACKGROUND OF THE INVENTION

1. Field of the Invention

The present invention relates to an electromagnetic wave absorber used for preventing the external leakage of unnecessary electromagnetic waves generated in communication equipment or electronic equipment, for preventing malfunction caused by mutual interference by said unnecessary electromagnetic waves among internal circuits and also for preventing the adverse effect by external electromagnetic waves. More particularly, the present invention relates to an electromagnetic wave absorber comprising a composite magnetic material having a soft magnetic material powder dispersed in a binding material.

2. Description of the Related Art

Problems regarding EMC (electromagnetic compatibility), in which unnecessary electromagnetic waves leak from the circuits of communication equipment and electronic equipment or such electromagnetic waves cause the equipment to malfunction, are more likely to occur, as smaller, lighter, and more sophisticated electronic equipment is made and the packaging density of electronic components increases drastically.

In addition, as recent communication and digital technologies advance, the applied frequency becomes higher, so that a point of view that is different from conventional one is necessary to address EMC. Further, in mobile phones that have recently been spread rapidly, the possibility of the adverse effect of radiated electromagnetic waves on the human body is also pointed out.

For measures against the generation and leakage of unnecessary electromagnetic waves and the malfunction caused by electromagnetic interference, methods of providing a shield to the source of the unnecessary electromagnetic waves or inserting a choke coil or a filter in a transmission line are generally employed. Along with such methods, methods for providing, near electronic components and circuits, an electromagnetic wave absorber having a soft magnetic material powder dispersed in a binding material such as a rubber or polymer material are also proposed and put to practical use. This electromagnetic wave absorber is excellent in processability and packaging ability and is highly practicable ("Recent Technology and Application of New Electromagnetic Wave Absorber," Mar. 10, 1999, CMC, pages 124 to 125, Japanese Unexamined Patent Application 11-87117, 11-354973, 2000-4097, and 2002-158488).

However, according to recent demands for smaller, lighter, and more sophisticated electronic equipment and for higher frequency as described above, especially thin, high-performance members addressing high frequency are also required as members for measures against unnecessary electromagnetic waves.

The electromagnetic wave absorption performance of an electromagnetic wave absorber is determined by the product of the imaginary part relative permeability $\mu''$ and the material thickness. Therefore, when the thickness is tried to be reduced, the value of the imaginary part relative permeability $\mu''$ should be increased. Specifically, a thickness of 1.0 mm or less is required recently, and in this case, the necessary imaginary part relative permeability $\mu''$ is required to be a value of 10 or more.

Conventionally, electromagnetic wave absorbers comprising a powder of an alloy that is widely known as a soft magnetic material, such as Fe—Al—Si (Sendust), Fe—Si (silicon steel), or Ni—Fe (Permalloy), combined with a binding material, such as a rubber or polymer material, are proposed in Japanese Unexamined Patent Application 11-87117, 11-354973, 2002-158488, and the like. By making flat the shape of this magnetic material powder, the imaginary part relative permeability $\mu''$ is increased at a high frequency range.

The imaginary part relative permeability $\mu''$ is changed by frequency, but with the above conventional flat alloy powders, the imaginary part relative permeability $\mu''$ shows a maximum value at 1 GHz or less, and it decreases monotonously at a frequency range of 1 GHz or more in many cases. Therefore, the value of the imaginary part relative permeability $\mu''$ is insufficient at a frequency range of 1 to 3 GHz, the application of which is recently promoted in portable phones and the like. In addition, with some of conventional flat alloy powders, in which the imaginary part relative permeability $\mu''$ shows a maximum value at 1 GHz or more (Japanese Unexamined Patent Application 11-87117), the value of the imaginary part relative permeability $\mu''$ itself is insufficient. Therefore, when the conventional flat alloy powders are used, the thickness of the electromagnetic wave absorber must be increased.

The imaginary part relative permeability $\mu''$ of an electromagnetic wave absorber comprising a soft magnetic material powder and a binding material follows the logarithmic mixing rule. Therefore, for obtaining a high imaginary part relative permeability $\mu''$, high volume fraction of the soft magnetic material powder has been adopted. However, if the volume fraction of the soft magnetic material powder is increased, the reflection of electromagnetic waves increases, which is not adequate for coping the problem of cross talk and the like inside electronic equipment.

Accordingly, the purpose of the present invention are to provide an electromagnetic wave absorber comprising a soft magnetic material powder and a binding material, which is thinner than conventional ones, has a high absorption performance for electromagnetic waves of 1 to 3 GHz, the application of which is promoted in electronic equipment and communication equipment, especially portable phones and the like, and, more preferably, has a small electromagnetic wave reflectance.

The inventors have studied for increasing the imaginary part relative permeability $\mu''$ of the electromagnetic wave absorber at 1 to 3 GHz without increasing the reflectance. As a result, it has been found that by using a flat powder of a soft magnetic material comprising an alloy of Ni-30–60% Fe, the imaginary part relative permeability $\mu''$ shows a maximum value at a frequency range of 1 to 3 GHz, and a large value (for example, 10 or more) can be obtained. Also, it has been found that by limiting the average diameter of the flat powder of the soft magnetic material in this case, a small electromagnetic wave reflectance can be obtained. The present invention is completed based on these findings.

SUMMARY OF THE INVENTION

The electromagnetic wave absorber of claim 1 of the present invention comprises a flat powder of a soft magnetic material and a binding material, wherein the composition of the flat powder of the soft magnetic material is Ni-30–60% Fe.

Ni-30–60% Fe means a Ni—Fe alloy containing 30 to 60% by weight of Fe. This electromagnetic wave absorber can be manufactured by orientation dispersion of an alloy of Ni-30–60% Fe in a binding material.

As the binding material, insulating rubber and polymer materials, and the like are used. Considering the function of the binding material, insulation property, and moldability for molding the electromagnetic wave absorbing material into various shapes, preferable examples include styrene resins, such as acrylonitrile-styrene-butadiene copolymer resins (ABS) and acrylonitrile-styrene copolymer resins (AS), polyester resins, such as polyethylene terephthalate resins (PET), polycarbonate resins, polyolefin resins, such as polyethylene, polypropylene and chlorinated polyethylene, cellulose resins, polyvinyl chloride resins, and polyvinyl butyral resins.

For the method of orientation dispersion, known methods, which are usually employed in this technical field, are employed.

In the electromagnetic wave absorber of claim 2 of the present invention, the flat powder of the soft magnetic material in claim 1 has an average diameter (the average of long and short diameters) of 30 $\mu$m or less. By decreasing the average diameter in this manner, the reflectance of electromagnetic waves can be reduced at a frequency range of 1 to 3 GHz. As a result, this electromagnetic wave absorber shows an electromagnetic wave reflectance of 20% or less at a frequency range of 1 to 3 GHz.

For the shape of the soft magnetic material powder, it is desirable that the flatness (average diameter/average thickness) is about 10 to 100. With a flatness of less than 10, the improvement of the imaginary part relative permeability $\mu''$ is small even if the volume fraction of the soft magnetic material powder is increased, and it is difficult to form a thin electromagnetic wave absorber. On the other hand, with a flatness of more than 100, it is difficult to maintain the shape during mixing with a rubber or polymer material and dispersion, and, as a result, an electromagnetic wave absorber having good properties cannot be obtained.

Thus, in the electromagnetic wave absorber of claim 3 of the present invention, the flat powder of the soft magnetic material has a flatness of 10 to 100.

However, if the soft magnetic material powder particles agglomerate on dispersing the soft magnetic material powder in the binding material, the electrical contact of the powder particles occurs, so that the powder diameter increases substantially. This makes the imaginary part relative permeability $\mu''$ decrease. Accordingly, for preventing the electrical contact of the powder particles, it is preferable to coat (surface treat) the surface of the soft magnetic material powder with an insulating material such as an organic matter or an oxide.

In the electromagnetic wave absorber of claim 4 of the present invention, the surface of the flat powder of the soft magnetic material is coated with an organic matter or an oxide. This surface treatment prevents the agglomeration of the soft magnetic material powder particles.

The oxide used for the surface treatment of the flat powder of the soft magnetic material includes insulating materials such as $TiO_2$ and $SiO_2$.

As the preferable organic matter used for the surface treatment of the flat powder, octadecanethiol and mixtures of octadecanethiol and a titanate coupling agent can be exemplified.

In the electromagnetic wave absorber of claim 5 of the present invention, the surface of the flat powder of the soft magnetic material is coated with octadecanethiol or a mixture of octadecanethiol and a titanate coupling agent. Thus, claim 5 corresponds to the above preferable mode.

BEST MODE FOR CARRYING OUT THE INVENTION

Figure 1:
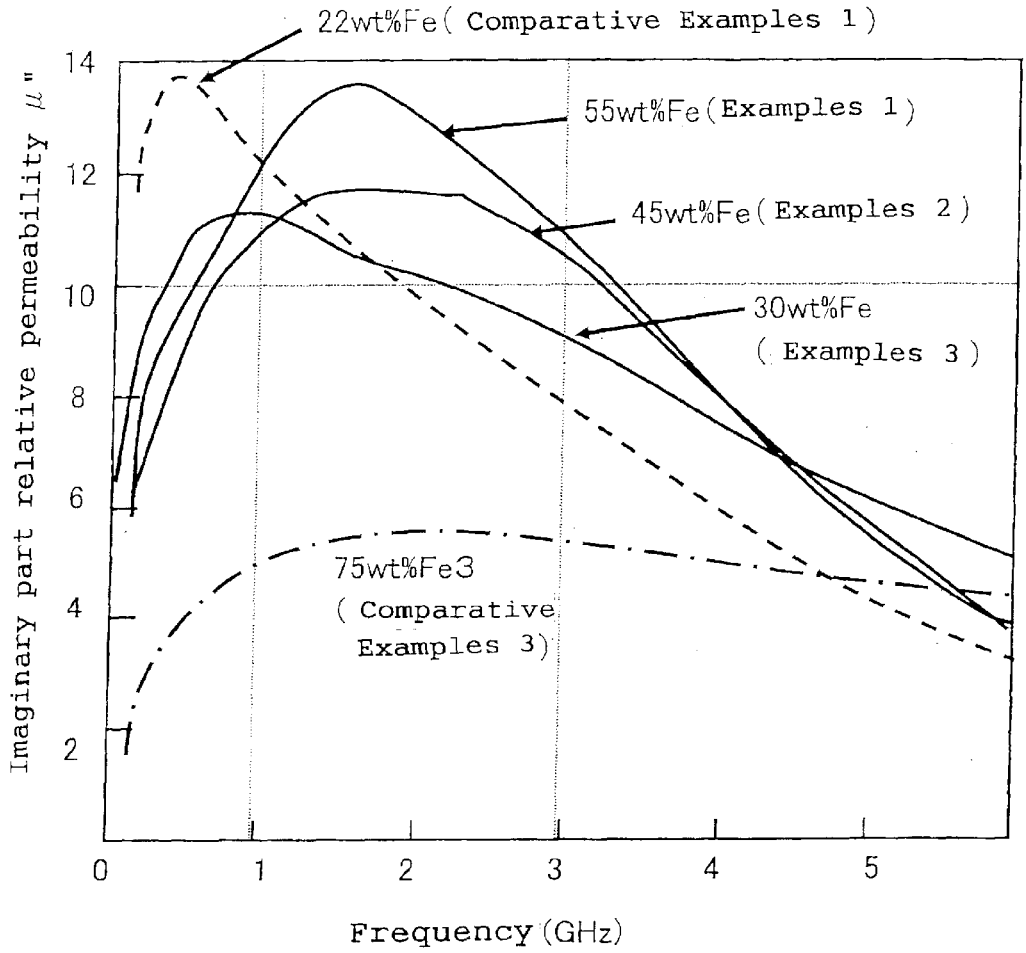
FIG. 1 is a graph showing the relationship between the frequency and the imaginary part relative permeability $\mu''$ in electromagnetic wave absorbers made in Examples 1, 2, and 3 and Comparative Examples 1 and 3.

As illustrated in the following examples and comparative examples, Ni—Fe alloy (referred to as Permalloy) powders having a different composition, which were manufactured by a general water atomization method (a method of manufacturing a powder by atomizing a molten metal from a nozzle in a water jet), were ground into a flat shape in an attritor (an average diameter of 20 $\mu$m and an average thickness of 0.5 $\mu$m). The powders were orientation dispersed in chlorinated polyethylene in such a manner that the volume fraction of the powders was 48% so as to make sheets. The complex permeability (the imaginary part relative permeability $\mu''$) of the sheets was measured. The results are shown in FIG. 1.

For Ni—Fe alloys, it is already known that a Ni-22% Fe alloy has a high soft magnetic property in a static magnetic field. From FIG. 1, it is seen that with the Ni-22% Fe alloy (Comparative Examples 1 and 2), the imaginary part relative permeability $\mu''$ shows a peak near 0.5 GHz and decreases monotonously at higher frequencies. On the other hand, the peak frequency shifts to higher frequencies as the Fe concentration increases. As a result of the above study, it is found that with 30% or more of Fe (Examples 1, 2, and 3), the peak frequency is 1 GHz or more.

Figure 2:
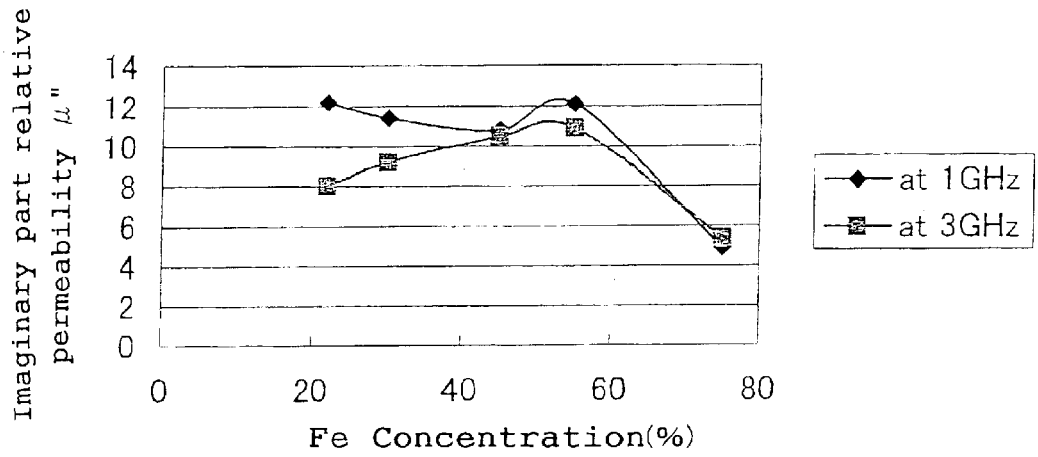
FIG. 2 is a graph showing the relationship between the composition of flat powders of soft magnetic materials (Fe concentration) and the imaginary part relative permeability $\mu''$ in electromagnetic wave absorbers made in Examples 1, 2, and 3 and Comparative Examples 1 and 3.

Based on the above study results, the values of the imaginary part relative permeability $\mu''$ at 1 and 3 GHz, with the Fe concentration represented by the horizontal axis, are shown in FIG. 2. From this, it is found that if the Fe concentration is higher than 60%, the imaginary part relative permeability $\mu''$ decreases at a wide range of frequency. (The Ni-22% Fe alloy is an alloy containing 22% by weight of Fe as described above, however, there is a concentration variation of about 1% depending on the product.)

Accordingly, it is found that when the Fe concentration is 30 to 60% in Ni—Fe alloys, the imaginary part relative permeability $\mu''$ can have a maximum value at a frequency range of 1 to 3 GHz, and a large value, for example 10 or more, can be obtained.

Figure 3:
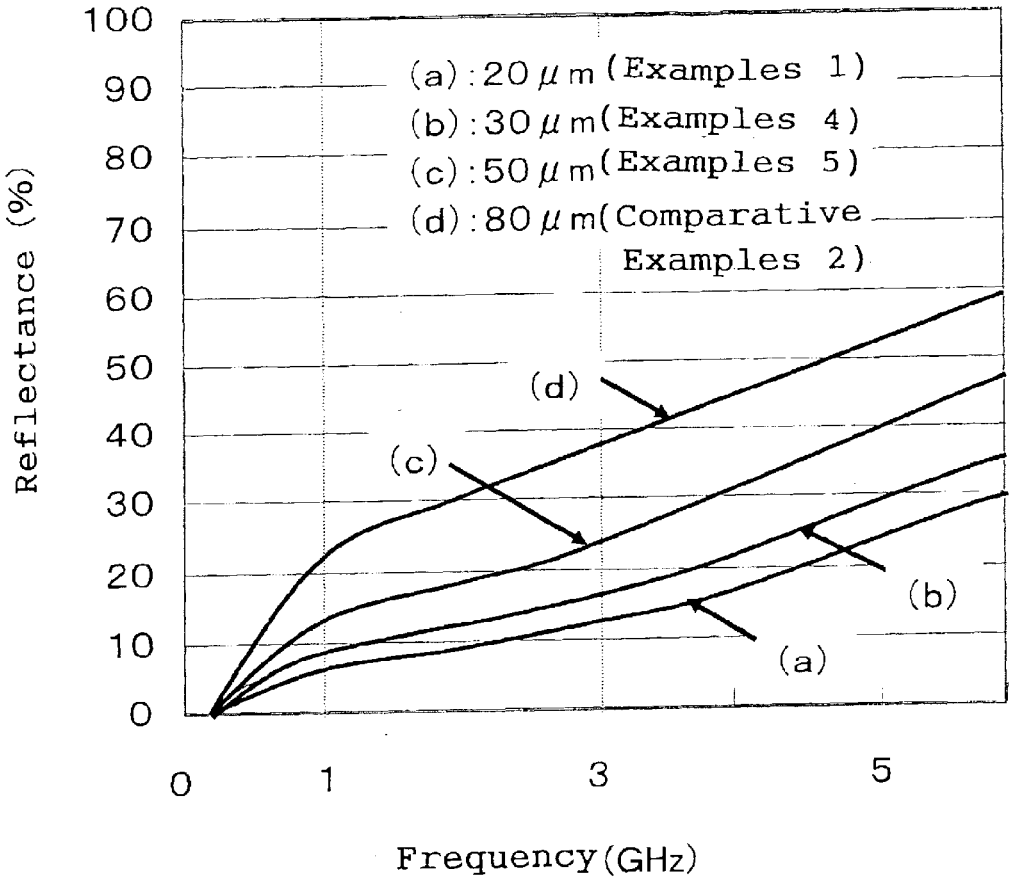
FIG. 3 is a graph showing the relationship between the frequency and the reflectance in electromagnetic wave absorbers made in Examples 1, 4, and 5 and Comparative Example 2.
Figure 4:
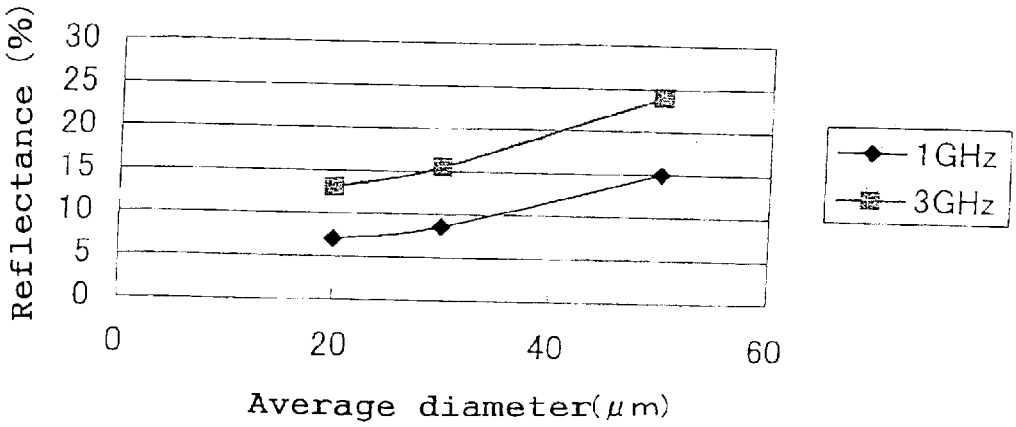
FIG. 4 is a graph showing the relationship between the average diameter and the reflectance in electromagnetic wave absorbers made in Examples 1, 4, and 5 and Comparative Example 2.

Electromagnetic wave absorbers were formed using flat powders of a soft magnetic material comprising a Ni-55% Fe alloy and having a thickness of 0.5 $\mu$m, with a volume fraction of 48%. Changes in the reflectance of electromagnetic waves were measured when the average diameter of the flat powder was changed to 20, 30, and 50 $\mu$m. The results are shown by (a), (b), and (c) in FIG. 3. The average diameter is an average value of long and short diameters, where the long diameter is the largest distances between two parallel lines tangent to the periphery of the flat surface, and the short diameter is the smallest distance. The values of reflectance at 1 and 3 GHz, with the average diameter represented by the horizontal axis, are shown in FIG. 4. From FIG. 4, it is found that the reflectance decreases as the average diameter decreases, and that the reflectance at 1 to 3 GHz can surely be 20% or less by making the average diameter 30 μm or less. It is more desirable that the average diameter is 20 μm or less because a reflectance of about 10% can be obtained at the above frequency range. However, when a flat powder is formed from a powder by mechanical grinding, it is practical that the above average diameter is about 5 μm or more.

EXAMPLE 1

A Ni-55% Fe powder made by a water atomization method was prepared as a soft magnetic material powder. The powder was ground in an attritor to flatten its shape (an average diameter of 20 μm and an average thickness of 0.5 μm). Successively, the powder was annealed at 650° C. in a nitrogen atmosphere for 2 hours to eliminate strain yielded during the flattening step.

Then, for preventing a substantial increase in powder diameter caused by agglomeration of the soft magnetic material powder particles, the powder surface was coated with an organic coating, using octadecanethiol, by the following method.

First, 10 g of octadecanethiol (manufactured by Wako Pure Chemical Industries, Ltd.) was weighed and added to 500 ml of ethanol (a highest quality reagent manufactured by Wako Pure Chemical Industries, Ltd.). The mixture was stirred to dissolve octadecanethiol so as to prepare an ethanol solution of octadecanethiol. 100 g of the soft magnetic material powder was weighed and added to the ethanol solution of octadecanethiol The mixture was stirred with a propeller stirrer for 1 hour and allowed to stand for about 30 minutes. Then, the supernatant was removed, and the residue was dried in the air in a thermostat at 80° C. for 30 minutes and cooled at room temperature to obtain the soft magnetic material powder coated with an organic coating. The amount of attached octadecanethiol was 0.56% by weight.

72 parts by weight of the flat powder of the soft magnetic material thus obtained, 20 parts by weight of chlorinated polyethylene, and 50 parts by weight of xylene were weighed to make a slurry for forming a film. In this case, chlorinated polyethylene was used as a binding material, and xylene was used as a solvent.

Then, the slurry was applied on a polyethylene terephthalate (hereinafter referred to as PET) film, to which a mold releasing agent was applied, with a thickness of 0.05 mm by the doctor blade method, and the film was held in a drying furnace at 60° C. for 2 hours to remove the solvent. An electromagnetic wave absorbing sheet was obtained by peeling from the PET film. The volume faction of the flat powder of the soft magnetic material in the obtained electromagnetic wave absorbing sheet was 48%.

The imaginary part relative permeability $\mu''$ and reflectance of the above electromagnetic wave absorbing sheet were measured with a network analyzer (HP8720B manufactured by Agilent Technologies). The imaginary part relative permeability $\mu''$ was a value of 10 or more at a frequency of 1 to 3 GHz, as shown in FIG. 1. The reflectance was about 10% (7 to 12%) at the same frequency range, as shown in FIG. 3(*a*).

EXAMPLE 2

Using a Ni-45% Fe powder, a flat powder of a soft magnetic material having an average diameter of 20 μm and an average thickness of 0.5 μm was made in a similar manner to that of Example 1. Using this flat powder, an electromagnetic wave absorbing sheet (the thickness was 0.05 mm and the volume fraction of the flat powder was 48%) was made in a similar manner to that of Example 1. The imaginary part relative permeability $\mu''$ of the sheet was measured. The result is shown in FIG. 1. As shown in FIG. 1, the imaginary part relative permeability $\mu''$ was maximized at a frequency of about 1.5 GHz and was a high value of 10 or more at a frequency of 1 to 3 GHz.

EXAMPLE 3

Using a Ni-30% Fe powder, a flat powder of a soft magnetic material having an average diameter of 20 μm and an average thickness of 0.5 μm was made in a similar manner to that of Example 1. Using this flat powder, an electromagnetic wave absorbing sheet (the thickness was 0.05 mm and the volume fraction of the flat powder was 48%) was made in a similar manner to that of Example 1. The imaginary part relative permeability $\mu''$ of the sheet was measured. The result is shown in FIG. 1. As shown in FIG. 1, the highest value of imaginary part relative permeability $\mu''$ was a high value of more than 10 at a frequency of around 1.0 GHz.

Comparative Example 1

Using a Ni-22% Fe powder, a flat powder of a soft magnetic material having an average diameter of 20 μm and an average thickness of 0.5 μm was made in a similar manner to that of Example 1. Using this flat powder, an electromagnetic wave absorbing sheet was made in a similar manner to that of Example 1. The imaginary part relative permeability $\mu''$ of the sheet was measured. The result is shown in FIG. 1. As shown in FIG. 1, the imaginary part relative permeability $\mu''$ decreased monotonously at frequencies of 1 to 3 GHz and was a value of 10 or less at a frequency range of 2 GHz or more. The reflectance was unchanged from Example 1.

Comparative Example 2

Using a Ni-22% Fe powder, a flat powder of a soft magnetic material having an average diameter of 80 μm and an average thickness of 0.5 μm was made in a similar manner to that of Example 1. Using this flat powder, an electromagnetic wave absorbing sheet was made in a similar manner to that of Example 1. When the imaginary part relative permeability $\mu''$ of the sheet was measured, it was unchanged from Comparative Example 1. The reflectance was higher than 20% (22 to 38%) at a frequency of 1 to 3 GHz, as shown in FIG. 3(*d*).

Comparative Example 3

Using a Ni-75% Fe powder, a flat powder of a soft magnetic material having an average diameter of 20 μm and an average thickness of 0.5 μm was made in a similar manner to that of Example 1. Using this flat powder, an electromagnetic wave absorbing sheet was made in a similar manner to that of Example 1. The imaginary part relative permeability $\mu''$ of the sheet was measured. The result is shown in FIG. 1. As shown in FIG. 1, the imaginary part relative permeability $\mu''$ was a value of far less than 10 at frequencies of 1 to 3 GHz.

EXAMPLE 4

Using a Ni-55% Fe powder, a flat powder of a soft magnetic material having an average diameter of 30 μm and an average thickness of 0.5 μm was made in a similar manner to that of Example 1. Using this flat powder, an electromagnetic wave absorbing sheet (the thickness was 0.05 mm and the volume fraction of the flat powder was 48%) was made in a similar manner to that of Example 1. The reflectance of electromagnetic waves was measured. The result is shown in FIG. 3(*b*).

EXAMPLE 5

Using a Ni-55% Fe powder, a flat powder of a soft magnetic material having an average diameter of 50 μm and an average thickness of 0.5 μm was made in a similar manner to that of Example 1. Using this flat powder, an electromagnetic wave absorbing sheet (the thickness was 0.05 mm and the volume fraction of the flat powder was 48%) was made in a similar manner to that of Example 1. The reflectance of electromagnetic waves was measured. The result is shown in FIG. 3(*c*).

EXAMPLE 6

Using a Ni-50% Fe powder, a flat powder of a soft magnetic material having an average diameter of 20 μm and an average thickness of 0.5 μm was made in a similar manner to that of Example 1. Using this flat powder, an electromagnetic wave absorbing sheet was made in a similar manner to that of Example 1. The imaginary part relative permeability μ" of the sheet was measured. The result is shown in FIG. 5.

EXAMPLE 7

An electromagnetic wave absorbing sheet was made according to the same manner as that of Example 6, except that the powder surface was not coated with an organic coating. The imaginary part relative permeability μ" of the sheet was measured. The result is shown in FIG. 5.

Figure 5:
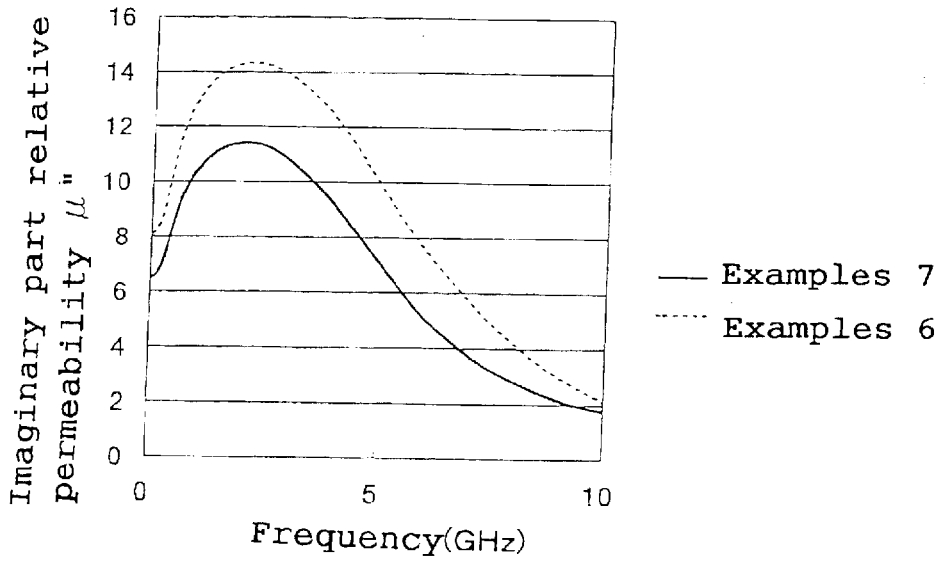
FIG. 5 is a graph showing the relationship between the frequency and the imaginary part relative permeability $\mu''$ in electromagnetic wave absorbers made in Examples 6 and 7.

From the results shown in FIG. 5, it is found that the octadecanethiol coating improves the imaginary part relative permeability μ". The improvement rate (the increase rate of the maximum value of the imaginary part relative permeability μ") was 8.4%.

EXAMPLES 8 AND 9

In each examples, an electromagnetic wave absorbing sheet was made according to the same manner as that of Example 6, except that octadecanethiol was replaced by the organic matter shown in the following Table 1. The imaginary part relative permeability μ" of the sheet was measured and the measured μ" was compared to that of Example 7 wherein the powder surface was not coated with an organic coating to obtain the improvement rate of μ". The result is shown in Table 1.

TABLE 1

| | Organic matter | Improvement rate of μ" (%) |
|---|---|---|
| Example 6 | Octadecanethiol | 8.4 |
| Example 8 | Octadecanethiol + titanate coupling agent (1:1 by weight) | 8.7 |
| Example 9 | Titanate coupling agent | 1.6 |

Octadecanethiol: $[CH_3(CH_2)_{17}SH]$ (manufactured by Wako Pure Chemical Industries, Ltd.)
Titanate coupling agent: KRTTS (manufactured by AJINOMOTO fine techno, Co., Ltd.)

As described above, in the electromagnetic wave absorber of the present invention, wherein the composition of the flat powder of the soft magnetic material is Ni-30–60% Fe, the imaginary part relative permeability μ" is a large value (for example, 10 or more) at a frequency range of 1 to 3 GHz. In other words, the electromagnetic wave absorber has a high absorption performance for electromagnetic waves in a frequency band, the application of which is promoted in electronic equipment and communication equipment, especially portable phones and the like. Therefore, the electromagnetic wave absorber can be preferably used for these equipments.

Further, in the electromagnetic wave absorber, wherein the flat powder of the soft magnetic material has an average diameter of 30 μm or less, the reflectance is 20% or less in this frequency band. Therefore, the electromagnetic wave absorber is more preferable.

In the electromagnetic wave absorber of the present invention, wherein the surface of the flat powder of the soft magnetic material is coated with an organic matter or an oxide, particularly octadecanethiol or a mixture of octadecanethiol and a titanate coupling agent, the imaginary part relative permeability μ" further improves.

What is claimed is:

1. An electromagnetic wave absorber comprising a flat powder of a soft magnetic material and a binding material, wherein the surface of the flat powder of the soft magnetic material is coated with octadecanethiol or mixture of octadecanethiol and a titanate coupling agent.

2. The electromagnetic wave absorber according to claim 1, wherein the flat powder of the soft magnetic material has an average diameter of 30 μm or less.

3. The electromagnetic wave absorber according to claim 1, wherein the flat powder of the soft magnetic material has a flatness of 10 to 100.

4. The electromagnetic wave absorber according to claim 2, wherein the flat powder of the soft magnetic material has a flatness of 10 to 100.

5. The electromagnetic wave absorber as in any of claims 1–3 or 4, wherein the surface of the flat powder of the soft magnetic material is coated with an organic matter or an oxide.

6. The electromagnetic wave absorber according to claim 1, wherein the soft magnetic material is a Ni—Fe alloy containing 45% by weight to 55% by weight of Fe.

* * * * *